US005165470A

United States Patent [19]

Maekawa et al.

[11] Patent Number: 5,165,470

[45] Date of Patent: Nov. 24, 1992

[54] PLUGGING APPARATUS FOR HEAT EXCHANGER

[75] Inventors: Akira Maekawa; Akira Shinomiya; Masaru Tomeoka, all of Kobe, Japan

[73] Assignee: Mitsubishi Jukogyo Kabushiki Kaisha, Tokyo, Japan

[21] Appl. No.: 754,518

[22] Filed: Sep. 4, 1991

[30] Foreign Application Priority Data

Sep. 5, 1990 [JP] Japan ..... 2-92710[U]

[51] Int. Cl.[5] ..... F28F 7/00

[52] U.S. Cl. ..... 165/76; 29/727

[58] Field of Search ..... 165/11.2, 76; 414/744.1, 750; 901/30, 41; 138/89; 29/727

[56] References Cited

U.S. PATENT DOCUMENTS

| | | | |
|---|---|---|---|
| 4,193,735 | 3/1980 | Savor et al. | 414/744.1 |
| 4,369,662 | 1/1983 | Rieben et al. | 73/862.01 |
| 4,373,855 | 2/1983 | Lebouc | 414/744.1 |
| 4,521,150 | 6/1985 | Pigeon et al. | 414/749 |
| 4,590,991 | 5/1986 | Cooper, Jr. et al. | 165/69 |
| 4,693,277 | 9/1987 | Bieber et al. | 138/89 |
| 4,779,496 | 10/1988 | Evans et al. | 82/82 |
| 5,025,854 | 6/1991 | Richter et al. | 165/11.2 |

FOREIGN PATENT DOCUMENTS

| | | |
|---|---|---|
| 0006339 | 1/1980 | European Pat. Off. . |
| 0208479 | 1/1987 | European Pat. Off. . |
| 0312418 | 4/1989 | France . |
| 0343368 | 11/1989 | France . |

*Primary Examiner*—Allen J. Flanigan

*Attorney, Agent, or Firm*—Wenderoth, Lind & Ponack

[57] ABSTRACT

A plugging apparatus for fixing a mechanical plug within a heat transfer tube of a heat exchanger includes a main body capable of being coupled to a tool guide robot movable under remote control inside a water chamber of the heat exchanger, a plug fixing mechanism mounted on the main body for conveying a mechanical plug from outside the heat exchanger and fixing the mechanical plug in the heat transfer tube, and a clamping mechanism for clamping the main body to a tube plate of the heat exchanger at a desired position on the tube plate of the heat exchanger. The invention makes it possible to fix a mechanical plug in a heat transfer tube of a steam generator or heat exchanger of a reactor in a remote-controlled and continuous manner.

4 Claims, 4 Drawing Sheets

PLUGGING APPARATUS FOR HEAT EXCHANGER

BACKGROUND OF THE INVENTION

1. Field of the Invention

This invention relates to a plugging apparatus for fixing a mechanical plug in a defective heat transfer tube of a steam generator or heat exchanger to bring the tube out of use.

2. Description of the Prior Art

A steam generator or heat exchanger installed in nuclear power plants and the like includes a large number of thin heat transfer tubes, and an end of each of the heat transfer tubes is inserted in a corresponding through-hole of a tube plate and is secured thereto. A heating medium (primary cooling water) heated by a heat source such as a reactor is passed through each heat transfer tube, so that heat exchange takes place between the heating medium and secondary cooling water flowing around the heat transfer tubes.

Such heat transfer tubes may be damaged by corrosion and the like, thereby resulting in water leakage. For preventing water leakage from a damaged heat transfer tube, a so-called mechanical plug repairing method is carried out in which, as shown in FIGS. 3 and 4, a mechanical plug (hereinafter referred to as a plug) is inserted into the heat transfer tube surrounded by a tube plate 3 and is sealed therein thereby preventing the primary water from flowing into the transfer tube 1. This method is carried out to bring the damaged heat transfer tube out of use. The details of this method are disclosed in U.S. Pat. No. 4,390,042 (corresponding to Japanese Patent Laid-Open No. 57-52799).

Specifically, as shown in FIG. 3, a plug body 7 of the plug 5 is cylindrical with one end closed, and a plurality of circumferential grooves 9 are formed on its outer peripheral surface at adequate intervals in the axial direction. The inner peripheral surface of the plug body 7 is tapered such that the inner diameter decreases progressively as approaching the open end. A cone 13 having a threaded through-hole 11 formed at its center is previously placed in the plug body 7.

A handling rod 15 is screwed into the threaded hole 11 of the cone 13 and is then pulled with a strong force in the direction of the arrow by a plugging apparatus (not shown). Consequently, as shown in FIG. 4, the plug body 7 is radially expanded and pressed against the inner surface of the heat transfer tube 1, so that the end of the heat transfer tube 1 is mechanically sealed with the plug 5. Then, the handling rod 15 is detached from the cone 13.

FIG. 5 is a simplified sectional view of a conventional plugging apparatus. As will be appreciated from this drawing, this plugging apparatus 17 includes a plugging cylinder 21 with a hollow shaft piston 19, and the handling rod 15 extends through the hollow shaft piston 19. The handling rod 15 is threadedly meshed with a threaded inner portion 23 of the hollow shaft piston 19, and by rotating a wheel 25 attached to the lower end of the handling rod 15, the handling rod 15 can be moved vertically in relation to the hollow shaft piston 19. The handling rod 15 has a threaded portion 27 at the upper end thereof which will be screwed into the threaded hole 11 in the cone 13 of the plug 5.

When putting the plug 5 in the heat transfer tube 1 using the foregoing plugging apparatus 17, first, the threaded upper portion 27 of the handling rod 15 is screwed into the threaded hole 11 in the cone 13, and while holding the plugging cylinder 21 in contact with the lower side of the tube plate 3, the plug 5 is inserted into the heat transfer tube 1. After the position of the plug 5 is settled, a stopper 29 threadedly fitted to the handling rod 15 is turned until it comes into contact with the lower end of the hollow shaft piston 19. Then, pressurized oil is supplied through a port 31 in the plugging cylinder 21; as a result, the hollow shaft piston 19 is moved down accompanied with a downward movement of the handling rod 15 and the cone 13. Consequently, the plug body 7 is radially expanded as described above, whereby the heat transfer tube 1 is sealingly plugged. Finally, the wheel 25 is turned to detach the handling rod 15 from the cone 13, whereby the plugging work is completed.

Similar plugging apparatus are disclosed in U.S. Pat. No. 4,369,662 (corresponding to Japanese Patent Laid-Open No. 57-151494), and U.S. Pat. No. 4,787,420 (corresponding to Japanese Patent Laid-Open No. 63-143495), etc.

Although making use of pressurized oil to pull the cone, the conventional plugging apparatus must be handled directly by a worker in a water chamber of the heat exchanger.

Therefore, although the plug will be reliably fixed, such repairing work is subject to severe restrictions when applied to the heat exchanger of a nuclear power plant. Namely, the working time of each worker in the water chamber is limited, since the inside of the water chamber is filled with the radioactive primary coolant and may be contaminated with radioactivity.

In other words, a large number of workers must be engaged since the level of exposure of each worker must be limited for health reasons.

SUMMARY OF THE INVENTION

It is an object of the present invention to provide a plugging apparatus by which the work of plugging a heat transfer tube with a mechanical plug can be carried out through remote control from outside the heat exchanger without operating people inside a water chamber.

To accomplish the foregoing object, the present invention provides a plugging apparatus for a heat exchanger, which comprises a main body capable of being coupled to a tool guide robot movable in a water chamber of the heat exchanger under remote control, a plug fixing mechanism mounted on the main body for conveying a mechanical plug from outside the heat exchanger and fixing the mechanical plug in the heat transfer tube, and a clamping mechanism for clamping the main body to a tube plate of the heat exchanger at a desired position on the tube plate of the heat exchanger.

Preferably, the plug fixing mechanism comprises a handling rod threadedly connectable to a cone of the mechanical plug, a remote-controllable plugging cylinder mounted on the main body for applying a pulling force to the handling rod, and which permits the mechanical plug and the handling rod to move through the inside thereof, a flexible shaft for rotating the handling rod and introducing the handling rod from outside the heat exchanger into the water chamber, a flexible tube for guiding the handling rod into the plugging cylinder, and a remote-controllable plug support cylinder mounted on the main body for supporting the mechanical plug inserted in the heat transfer tube.

Preferably, the clamping mechanism comprises a rotatable mounting plate, a clamping actuator mounted on the rotatable mounting plate, and a locking cylinder for locking the rotatable mounting plate in position relative to same main body.

When operating the plugging apparatus according to the present invention, the main body is disposed at a desired position in a water chamber of a heat exchanger by means of the tool guide robot, the main body is clamped on the lower side of a tube plate by means of the clamping mechanism, and then, a mechanical plug is sent from outside the heat exchanger into a defective heat transfer tube and is fixed there by means of the plug fixing mechanism.

According to the present invention, specifically, the handling rod with the plug attached thereto via its cone is sent from outside the heat exchanger through the flexible tube into the water chamber by means of the flexible shaft, and then, the plug is inserted through the inside of the plug fixing mechanism into the defective heat transfer tube. Then, the plug is supported by means of the plug support cylinder, and the handling rod is pulled by the plugging cylinder; as a result, the plug body is radially expanded by the cone threadedly connected to the handling rod, whereby the plug comes into tight contact with the inner surface of the defective heat transfer tube, thereby sealing the defective heat transfer tube. The handling rod threadedly connected to the cone of the plug is separated from the plug by rotating the flexible shaft in a predetermined direction.

DETAILED DESCRIPTION OF THE PREFERRED EMBODIMENT

Figure 1:
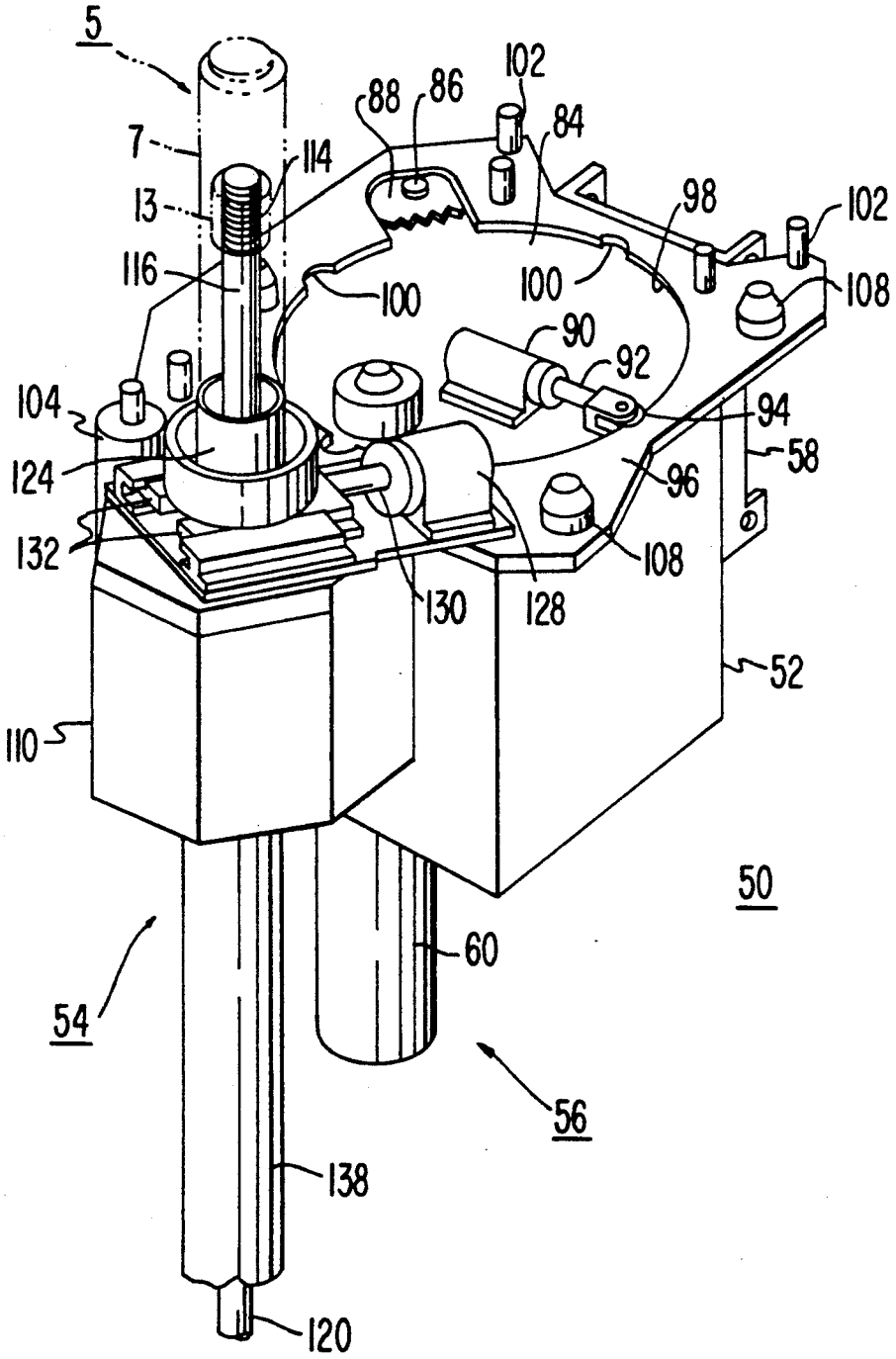
FIG. 1 is a perspective view of a plugging apparatus according to the present invention.

A preferred embodiment of the present invention will hereinafter be described in greater detail with reference to the drawings in which identical or corresponding components are designated by the same reference numeral.

Figure 2:
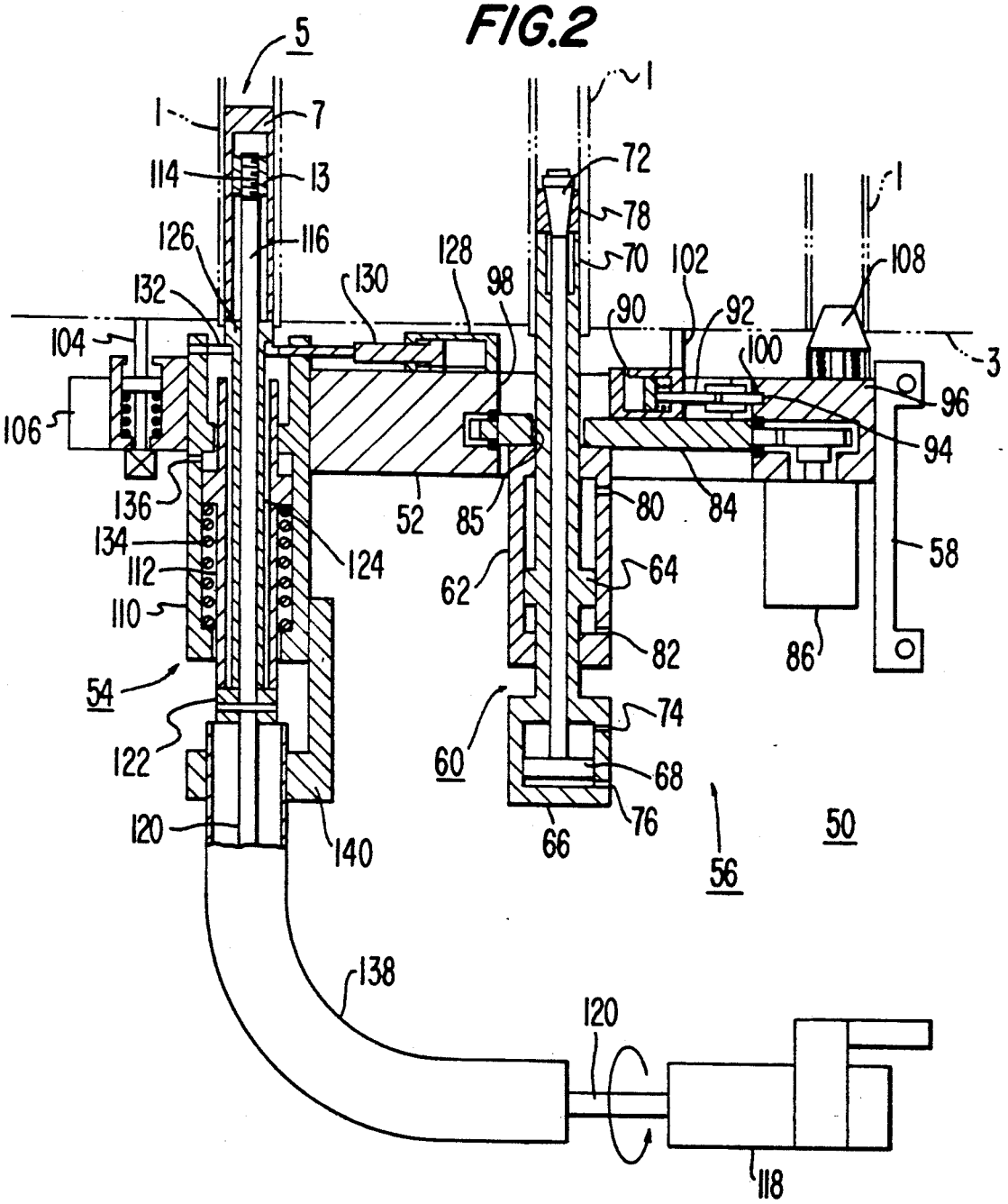
FIG. 2 is a sectional view of the plugging apparatus shown in FIG. 1.
Figure 4:
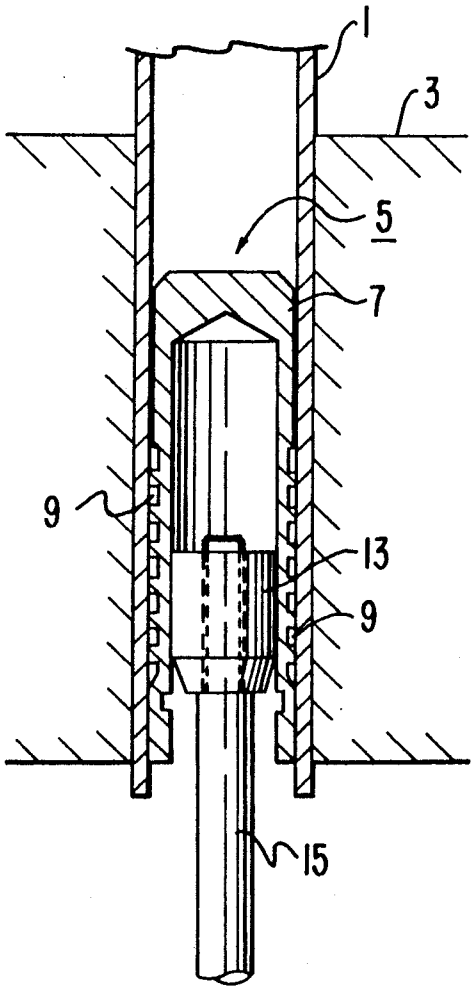
FIG. 4 (PRIOR ART)
FIGS. 3 and 4 are fragmentary sectional views explanatory of a mechanical plug repairing method.
Figure 3:
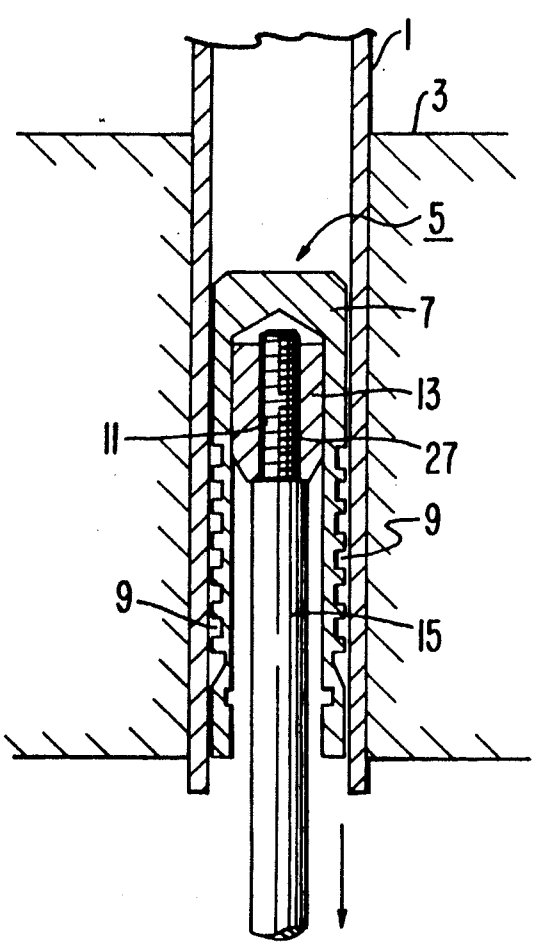
FIG. 3 (PRIOR ART)

FIG. 1 is a perspective view of a plugging apparatus according to the present invention, and FIG. 2 is a sectional view of the plugging apparatus having a plug in a heat transfer tube. As shown, the plugging apparatus 50 comprises a main body 52, a plug fixing mechanism 54 mounted on the main body 52, and a clamping mechanism 56 for clamping the main body 52 to a tube plate 3 of a heat exchanger. The main body 52 is provided with an attaching plate 58 for connection with a tool guide robot (not shown) which is known in the art and designed to move in a water chamber of a heat exchanger under remote control.

The clamping mechanism 56 is provided with a clamping actuator 60 of the cotter type. The clamping actuator 60 includes a clamping cylinder 62 secured to the main body 52, a hollow shaft piston 64 slidable vertically inside the clamping cylinder, and an auxiliary cylinder 66 provided integrally at the lower end of the hollow shaft piston 64. A piston 68 is arranged in the auxiliary cylinder 66, and a mandrel 70 connected to the piston 68 extends upwardly in the hollow shaft piston 64. The upper end of the mandrel is shaped to define a tapered portion 72, and a cotter 78 provided at the upper end of the hollow shaft piston 64 can be expanded radially when compressed air is supplied through a port 74 into the auxiliary cylinder 66 thereby moving the piston 68 down. When the cotter 78 is radially expanded in a heat transfer tube 1 as shown in FIG. 2, the cotter 78 is pressed against the inner surface of the heat transfer tube 1; consequently, the clamping actuator 60 as well as the main body 52 is clamped to the tube plate 3. By selectively supplying compressed air through ports 80 and 82 into the clamping cylinder 62, the hollow shaft piston 64 can be moved up or down.

The clamping cylinder 62 is secured to a rotatable plate 84, and the hollow shaft piston 64 extends upward through a through-hole 85 machined in the rotatable plate 84. The rotatable plate 84 is supported inside the main body 52 so that it can rotate in a substantially horizontal plane. The rotatable plate 84 has a number of teeth machined in the circumference thereof which are in engagement with a gear 88 on a rotary shaft of a positioning motor 86 mounted on the main body 52. Therefore, when the motor 86 is energized, the rotatable plate 84 rotates in a horizontal plane to rotate the clamping actuator 60.

A positioning cylinder 90 is mounted on the upper surface of the rotatable plate 84 and extends laterally. This positioning cylinder 90 has a roller 94 supported at the distal end of its piston 92, this roller being rollable on and along the peripheral surface 98 defining a circular opening machined in an upper plate 96 of the main body 52. This circular opening is aligned with the center of rotation of the rotatable plate 84, and the positioning cylinder 90 extends in the radial direction of the rotatable plate 84. The peripheral surface 98 defining the circular opening also defines a plurality of recesses 100. When the positioning cylinder 90 is actuated and the roller 94 is caught in one recess 100, the clamping cylinder 62 is set in position. In the embodiment illustrated, the recesses 100 are formed at four points corresponding to the pitch of the heat transfer tubes 1 so that the clamping cylinder 62 can be positioned correspondingly in any one of four heat transfer tubes 1.

In the drawings, reference numeral 102 designates a gap-ensuring pin, numeral 104 a detector for sensing the closeness of the plugging apparatus to the tube plate, numeral 106 a TV camera, and numeral 108 a positioning guide. These components will be described later.

Figure 5:
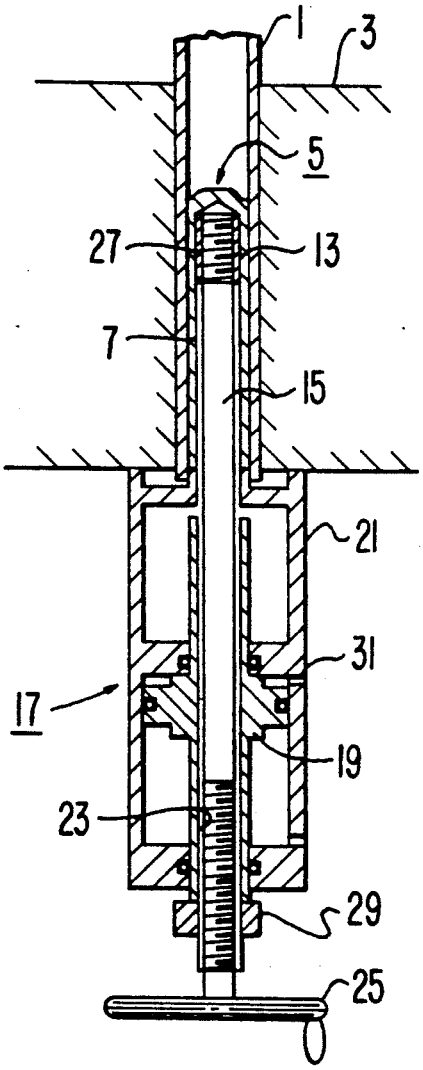
FIG. 5 (PRIOR ART)
FIG. 5 is a simplified sectional view of a conventional plugging apparatus.

The plug fixing mechanism 54 includes a plugging cylinder 110 extending vertically and secured to the main body 52, and a hollow shaft piston 112 is disposed inside the plugging cylinder 110. The inside of the hollow shaft piston 112 is designed to serve as a rod passage through which a handling rod 116 with a threaded end 114 connectable to the cone 13 of the plug 5 is movable. It should be noted that in contrast to the conventional structure (see FIG. 5), the inner diameter of the rod passage has such a size that the plug 5 together with the handling rod 116 can move therethrough.

The handling rod 116 is driven with a flexible shaft 120 by an air motor 118 provided outside the heat exchanger. It should be noted that when the air motor 118 is rotated in the forward direction, the handling rod 116 while rotating in the forward direction is carried into the heat exchanger, whereas when the air motor 118 is rotated in the reverse direction, the handling rod 116 while rotating in the reverse direction is pulled out of the heat exchanger.

The flexible shaft 120 is connected to the lower end of the handling rod 116 via a coupling 122, and this coupling 122 is designed so that when the plug 5 reaches a given position inside the heat transfer tube 1, the coupling comes into contact with the lower end of the hollow shaft piston 112.

The handling rod 116 has a guide sleeve 124 slidably arranged therearound. This guide sleeve 124 can pass through the inside of the hollow shaft piston 112. The upper end of the guide sleeve 124 is larger in a radial direction than the lower end to define a flange 126. The lower end of the plug 5 is supported on the upper surface of the flange 126 when the plug 5 is attached to the handling rod 116.

A plug support cylinder 128 is mounted to and extends laterally on the upper surface of the main body 52. The distal end of a piston 130 extending from the cylinder 128 toward the axial center line of the hollow shaft piston 112 is shaped so as to define a fork-like member 132. When the piston 130 is extended from the state shown in FIG. 2, the fork-like member 132 comes under the flange 126 of the guide sleeve 124 to hold the guide sleeve 124. In this condition, the plug 5 supported by the flange 126 of the guide sleeve 124 is prevented from moving down.

Although the hollow shaft piston 112 is normally retained at a high position by a spring 134, when compressed air is supplied through a port 136 to the plugging cylinder 110, the piston 112 is moved down, so that a downward pulling force is applied to the handling rod 116 connected via the coupling 122 to the lower end of the piston 112.

A flexible tube 138 extending from the inside of the water chamber to the outside of the heat exchanger is supported by a bracket 140 of the plugging cylinder 110 at its inner end. Specifically, one end of the flexible tube 138 is disposed coaxially with the hollow shaft piston 112 and the other end is outside the heat exchanger. Therefore, by advancing the handling rod 116 with the flexible tube 138, it can be reliably introduced from outside the heat exchanger into the hollow shaft piston 112.

The procedure of fixing the plug 5 in the defective heat transfer tube 1 by the use of the foregoing plugging apparatus 50 will now be described.

First, the tool guide robot (not shown) with the main body 52 attached thereto via the attaching plate 58 is remote-controlled so that the plugging apparatus 50 is located at a given position under the tube plate 3. In this regard, by fitting the top of the positioning guide 108 in the lower end of the heat transfer tube 1, the positioning of the plugging apparatus 50 can be reliably carried out.

Then, the positioning motor 86 is energized to rotate the rotatable plate 84 so that the clamping cylinder 62 is set just under a heat transfer tube 1. The foregoing steps are carried out under remote control while monitoring the situation with the TV camera 106. Then, by driving the positioning cylinder 90, the roller 94 at the distal end of the piston 92 engages the main body 52 within a recess 100 lock the rotatable plate 84 in position.

Then, compressed air is supplied through the port 82 into the clamping cylinder 62, whereby the hollow shaft piston 64 is moved up and the cotter 78 is inserted into the heat transfer tube 1. Compressed air is supplied through the port 74 into the auxiliary cylinder 66, so that the piston 68 and the mandrel 70 are moved down and the cotter 78 is pressed against the inner surface of the heat transfer tube 1 and is secured thereto by means of the tapered portion 72 of the mandrel. After being secured, compressed air is supplied through the port 80 into the clamping cylinder 62, whereby the hollow shaft piston 64 is moved down in relation to the clamping cylinder 62, and since the cotter 78 has been secured to the heat transfer tube 1, the main body 52 is moved up. When the upper end of the gap-ensuring pin 102 comes into contact with the lower side of the tube plate 3, the plugging apparatus 50 is reliably held to the tube plate 3. It will be clear that the detector 104 (for sensing the closeness of the plugging apparatus 50 to the tube plate) can be used to remotely confirm if the plugging apparatus 50 is clamped to the lower side of the tube plate 3 with a given gap left therebetween.

After the plugging apparatus 50 is clamped to the tube plate 3 as described above, the handling rod 116 with the plug 5 attached thereto (by screwing the threaded end 114 into the cone 13) is inserted into the flexible tube 138, this step being carried out outside the heat exchanger. The air motor 118 is rotated in the forward direction, so that the handling rod 116 is forwarded by the flexible shaft 120 together with the plug 5 and is inserted into the hollow shaft piston 112 of the plugging cylinder 110. Since the hollow shaft piston 112 is positioned coaxially with the defective heat transfer tube 1 to be repaired, the forwarding action causes the plug 5 to be inserted into the defective heat transfer tube 1. When the coupling 122 comes into contact with the lower end of the hollow shaft piston 112, the plug 5 is located at a desired position in the heat transfer tube 1 and the air motor 118 is stopped.

Then, the plug support cylinder 128 is operated to extend the piston 130 until the fork-like member 132 comes under the flange 126 of the guide sleeve 124, thereby supporting the flange 126 so as to prevent the plug 5 from moving down. The thus attained state is shown in FIG. 2.

Compressed air is supplied to the port 136 of the plugging cylinder 110, so that the hollow shaft piston 112 is moved down against the spring 134 and the pulling force of the hollow shaft piston 112 is applied through the coupling 122 to the handling rod 116. Consequently, the handling rod 116 pulls down the cone 13 of the plug 5 in relation to the plug body 7 to radially expand the plug body 7 as described above, so that the plug body 7 is tightly secured to the inner surface of the heat transfer tube 1, thereby sealing the heat transfer tube 1.

After the heat transfer tube 1 is sealed with the plug 5, the air motor 118 is rotated in the reverse direction to separate the handling rod 116 from the cone 13 of the plug 5. The handling rod 116 is pulled out of the heat exchanger, through flexible tube 138, and then the plugging cylinder 110 and the plug support cylinder 128 are operated to return to their initial positions. By releasing the clamping actuator 60 from the heat transfer tube 1, the plugging of the heat transfer tube 1 is completed.

Since the plug fixing mechanism 54 and the clamping mechanism 56, as well as the tool guide robot and the like, can be remote-controlled, no workers are required to enter the heat exchanger in carrying out the foregoing work.

As described above, the plugging apparatus according to the present invention makes it possible to carry out the plugging of the heat transfer tubes with mechanical plugs in a remote-control and continuous manner.

Therefore, for the heat exchanger of a nuclear power plant, no worker is required to manipulate the apparatus inside of the water chamber where radioactivity is at a critical level; thus, the exposure of each worker is remarkably limited, and the number of workers and working steps is reduced, leading to cost reductions.

What is claimed is:

1. Plugging apparatus for fixing a mechanical plug within a heat transfer tube of a heat exchanger, said apparatus comprising:

a main body;

a plugging cylinder mounted to said main body, said plugging cylinder including an open-ended cylinder body and a piston slidably received therein, said piston defining a passageway extending therethrough and said piston extending from an end of said cylinder body;

a handling rod having an outer diameter smaller than that of the passageway in said piston so as to be movable through said plugging cylinder via said passageway, said handling rod having a threaded portion at one end thereof;

a flexible shaft connected to said handling rod at the other end thereof;

a coupling integral with said handling rod at said other end thereof, said coupling engageable with the piston of said plugging cylinder to limit the insertion of said handling rod through said plugging cylinder;

a flexible tube extending from said plugging cylinder adjacent said end of the cylinder body thereof and cooperating with said handling rod and flexible shaft so as to guide said handling rod into and out of said plugging cylinder; and a clamp fixed to said main body, the apparatus being securable to a heat exchanger with said clamp.

2. Plugging apparatus as claimed in claim 1, wherein said clamp includes a plate rotatably supported on said main body, a clamp actuator mounted to said rotatable plate so as to be rotatable therewith, and a locking mechanism fixed to said rotatable plate and engageable with said main body so as to lock the rotatable plate in position relative to said main body.

3. Plugging apparatus for fixing a mechanical plug within a heat transfer tube of a heat exchanger, said apparatus comprising:

a main body;

attaching means for coupling said main body to a tool guide robot movable in a water chamber of the heat exchanger under remote control;

plug fixing mechanism means mounted on said main body for feeding a mechanical plug from outside the heat exchanger and fixing the mechanical plug in a heat transfer tube of the heat exchanger, said plug fixing mechanism means including a handling rod having a threaded portion so as to be threadedly connectable to a wedge cone of the mechanical plug, a plugging cylinder mounted on said main body, said plugging cylinder defining a passageway therethrough through which said handling rod with the mechanical plug connected thereto can pass, and said plugging cylinder being engageable with said handling rod and being actuatable under remote control to engage said handling rod and apply a pulling force to said handling rod, flexible shaft means connected to said handling rod for rotating the handling rod and introducing the handling rod into the water chamber of the heat exchanger and into said plugging cylinder from outside the heat exchanger, flexible tube means extending from said plugging cylinder for guiding the handling rod and the plug into said plugging cylinder, and remote-controllable plug support cylinder means mounted on said main body for supporting the mechanical plug inserted in the heat transfer tube to be plugged; and clamping mechanism means for clamping said main body to a tube plate of the heat exchanger so as to position the plug fixing mechanism means at a desired position on the tube plate of the heat exchanger.

4. Plugging apparatus as claimed in claim 3, wherein said clamp mechanism means includes a plate rotatably supported on said main body, a clamp actuator mounted to said rotatable plate so as to be rotatable therewith, and locking cylinder means for locking the position of said rotatable plate relative to said main body.

* * * * *